United States Patent [19]

Heikkilä et al.

[11] Patent Number: 4,899,463

[45] Date of Patent: Feb. 13, 1990

[54] METHOD AND DEVICE IN A CYLINDER DRYER OF A PAPER MACHINE

[75] Inventors: Pertti Heikkilä, Raisio; Markku Karlsson, Parainen; Hannu Kokkala, Turku, all of Finland

[73] Assignee: Valmet Paper Machinery Inc., Finland

[21] Appl. No.: 251,542

[22] Filed: Sep. 29, 1988

[30] Foreign Application Priority Data

Sep. 29, 1987 [FI] Finland ..... 874266

[51] Int. Cl.[4] ..... F26B 13/08

[52] U.S. Cl. ..... 34/23; 34/114; 34/116

[58] Field of Search ..... 34/116, 115, 114, 117, 34/23, 155; 162/290

[56] References Cited

U.S. PATENT DOCUMENTS 4,539,762 9/1985 Eskelinen et al. ..... 34/116 X 4,694,587 9/1987 Eskelinen ..... 34/116 X

*Primary Examiner*—Henry A. Bennet

*Assistant Examiner*—John Sollecito

*Attorney, Agent, or Firm*—Steinberg & Raskin

[57] ABSTRACT

Method and device in a cylinder dryer of a paper machine, in which a paper web is guided in connection with upper cylinders by using an upper wire and in connection with lower cylinders by using a lower wire. The wires are guided by faces of the respective drying cylinders and by guide rolls situated in spaces between the cylinders so that on an upper line of cylinders the web is pressed by the upper wire into direct drying contact with the faces of the upper cylinders, and the web is pressed by the lower wire into the faces of the lower cylinders in a lower line of the cylinders. In the method and in the device, the web is passed from one line of cylinders to the other over a certain distance as an open draw. A drying-air blowing is directed at the drying wires within an area of a line at which the respective drying wires are detached from the respective drying cylinders. By way of such blowings, a moist boundary layer which is derived from water diffused in connection with the wires and from the web to be dried, is disrupted.

8 Claims, 4 Drawing Sheets

METHOD AND DEVICE IN A CYLINDER DRYER OF A PAPER MACHINE

BACKGROUND OF THE INVENTION

The present invention concerns a method in a cylinder dryer of a paper machine, in which a paper web is guided in conjunction with upper cylinders by utilizing an upper wire and in conjunction with lower cylinders by utilizing a lower wire. These wires are guided by the faces of the respective drying cylinders and by guide rolls situated in the spaces between the respective cylinders so that on an upper line of cylinders the web is pressed by the upper wire into direct drying contact with the faces of the upper cylinders and correspondingly the web is pressed by the lower wire onto the faces of the lower cylinders. Additionally, the web is passed from one line of cylinders to the other over a certain distance as an open draw.

The present invention additionally concerns a device for such a cylinder dryer of a paper machine in which a twin-fabric draw is utilized, and in which the device can be located in the spaces between the adjoining drying cylinders. Such spaces are defined by the drying wires running over the adjoining drying cylinders and by free sectors of the guide rolls guiding the drying wires. The device comprises a blow box which extends substantially over the entire width of the drying wires and in which there is at least one nozzle slot or a corresponding series of nozzle holes.

In the present application, a "single-wire draw" means such a mode of passing the web over the heated drying cylinders in which the web runs from one line of cylinders to the other supported by the drying wire, so that on one line of cylinders the web is situated between the drying wire and the cylinder face, while on the other line of cylinders the web is situated outside and the drying wire is situated between the cylinder face and the drying fabric or web, with the web running in the draws between the lines of cylinders while being supported by the drying wire. An advantage of this single-fabric draw is that the web is at all times supported by the drying wire, and has no open draws or at least no substantially long open draws, whereby risk of wrinkles and breaks in the web is reduced.

In the present application, a "twin-wire draw" means the prior art mode of supporting and drawing the web in conjunction with the heated drying cylinders, in which an upper wire is used in connection with the upper cylinders and a lower wire is used in connection with the lower cylinders. These wires are guided by the faces of the respective drying cylinders and by guide rolls situated in the spaces between the respective drying cylinders so that along the upper line of cylinders the web is pressed by the upper wire into direct drying contact with the faces of the upper cylinders, and the web is correspondingly pressed by the lower wire against the faces of the lower cylinders.

The present invention is expressly related to a twin-wire draw.

With a twin-wire draw, the web had usually has substantially long open draws as the web passes from one line of cylinders to the other. These open draws have been susceptible to fluttering and to resulting breaks and wrinkles in the web. This drawback has been manifested with particular emphasis in the initial part of the drying section, where the web is still relatively moist and therefore of low strength, and where its elastic properties are conducive to fluttering.

Present day opinions are that the fluttering of the web results mainly from excessively strong internal flows in a pocket and from differences in pressure prevailing both in pockets and also in nips formed by the web and the wire and by the cylinder faces. Such strong air flows and the differences in pressure that are produced are the results of boundary-layer flows, which are induced by the wires, by the web, and by the cylinder faces as they move.

In the prior art, attempts have been made to eliminate the drawbacks resulting from fluttering of the web, by making the open draws of the web in the initial part of the drying section shorter by placing the imaginary planes extending through the axes of the upper and lower lines of cylinders at a shorter distance from one another than what had been customary or what would be optimal, e.g., in view of the efficiency of drying.

Attempts have also been made to reduce the fluttering of the paper web in a drying group provided with a twin-wire draw by displacing the felt guide rolls so that the paper web has to run a shorter distance unsupported.

The open draws of the web, the free faces of the cylinders, as well as the wires or felts guided by guide rolls define pockets inside the multi-cylinder dryer. These pockets are open at the ends thereof but in other respects are closed. Ventilation of these pockets has been considered an important factor in view of the efficiency and uniformity of the drying (moisture profile) in a multi-cylinder dryer.

In a manner known in the prior art, the regulation of the moisture profile in these pockets has been arranged so that the blow pipes present in the pockets have been divided into blocks in a transverse direction of the machine. These blocks can be opened and closed so as to regulate the quantity of air blown into the pocket. With respect to this solution, reference is made to the Valmet FI Pat. No. 68,278.

In recent years, the running speeds of paper machines have been constantly increasing. Now, the limit of 1,500 m/min is already approaching. The fluttering of the open draws of the web is becoming an ever more serious problem, hampering the running quality of the paper machine.

A particular object of the present invention is to reduce the problems of fluttering described above.

With a twin-wire draw, a moist boundary layer is produced on the wire when the wire runs on the cylinder as water vapor evaporated from the paper is diffused through the wire. When the wire departs from the cylinder, this moist boundary layer goes through the wire into the pocket because of the negative pressure present in the nip.

With respect to the prior art most closely related to the present invention, reference is made to the Valmet FI Published Patent Application No. 73,259 and FI Patent Applications Nos. 854494 and 872691. The starting point of the present invention involves the methods and devices suggested in the above patents and documents. However, it has not been possible to break the above moist boundary layer produced on the wire in a twin-wire draw or to eliminate the drawbacks caused by this phenomenon, by means of these methods and devices.

SUMMARY OF THE INVENTION

Thus, it is an object of the present invention to eliminate the drawbacks noted above.

It is an additional object of the present invention to provide a method and a device by means of which more dry air can be passed into the concomitant pocket formed in the twin-wire draw, so as to ventilate this pocket.

It is a further object of the present invention to provide a method and a device wherein the amount of air to be passed into this defined pocket can be increased much more than the amount of air that leaves the pocket by the effect of pumping out by the wire, so that the pocket can be subjected to positive pressure which, for its part, is intended to straighten the distribution of the moisture profile of the drying air in the pocket and to prevent fluttering of the web, especially in the lateral areas of the web.

It is another object of the present invention to provide a method and a device which is also efficient in view of the capacity of adjusting the transverse moisture profile of the web.

These and other objects are attained by the present invention which is directed to a method in a cylinder dryer of a paper machine in which a paper web is guided by an upper wire around upper cylinders and by a lower wire around lower cylinders. These wires are guided over faces of the respective cylinders and by guide rolls situated in spaces between respective upper cylinders or respective lower cylinders, so that the web is pressed by the upper wire into direct drying contact with the faces of the upper cylinders along an upper line of cylinders, and correspondingly pressed by the lower wire onto the faces of the lower cylinders along a lower line of cylinders. Furthermore, the web is additionally passed from one line of cylinders to the other over a certain distance as an open draw.

More specifically, the method comprises the steps of directing a blowing of drying air at at least one of the drying wires within an area of a line at which the respective drying wire is detached from a respective cylinder, and thereby disrupting a moist boundary layer which is derived from water diffused from the web onto the respective wire. The blowing of the drying air is preferably directed at both the upper and lower drying wires and within an area of a line at which the respective upper or lower drying wire is detached from at least one respective upper or lower cylinder. The blowing of the air is more preferably directed within areas of respective lines at which the respective upper and lower drying wires are detached from a plurality of respective upper or lower cylinders.

The present invention is also directed to a device in a cylinder dryer of a paper machine in which a twin-fabric draw is used. This device is located in at least one of spaces between adjoining drying cylinders and defined by a respective one of the drying wires running over the adjoining cylinders and by free sectors of guide rolls for guiding the respective drying wire.

More specifically, the device comprises a blow box extending over substantially the entire transverse width of the respective drying wire and comprising, as a nozzle slot or corresponding series of nozzle holes, a first blow nozzle situated transversely substantially over the entire width of the respective drying wire and within an area in which the respective drying wire is detached from a web and from a respective cylinder while running further to a respective guide roll. The first blow nozzle is directed or oriented in such a way that it is possible to provide through the nozzle, a blowing that efficiently disrupts a boundary layer of moist air that has developed on the respective wire. The device preferably comprises a pair of blow boxes, each blow box situated to direct air towards a respective upper or lower wire.

In view of achieving the objects noted above and those that will become apparent below, the method of the present invention is principally characterized by a drying-air blowing being directed at the drying wires within the an of the line at which the drying wire is detached from the drying cylinder and disrupting, by means of such blowings, the moist boundary layer which is derived from the water diffused in connection with the wires from the web to be dried.

On the other hand, the device in accordance with the present invention is principally characterized by the device comprising a first blow nozzle which is situated transversely substantially over the entire width of the drying wire within the area in which the drying wire is detached from the web and from the drying cylinder while running further onto the guiding roll therefor, and by the first blow nozzle being directed in such a way that through this nozzle it is possible to provide a blowing that efficiently disrupts the boundary layer of moist air that has developed on the wires.

According to the invention, the moist boundary layer developed on the drying wires in the manner described above is blown apart before the line at which the wire departs from the drying cylinder. This disrupting of the boundary layer is produced by means of an air jet blown towards the wire, this air jet being introduced out of a nozzle or nozzles directed in such a way that the boundary layer can be disrupted as efficiently as possible and, at the same time, a sufficient amount of dry air can be blown into the space between the wall of the blowing device and the wire within the run of the wire that extends from the drying cylinder onto the adjoining guide roll.

According to a preferred embodiment of the present invention, air jets are blown by means of a second nozzle into an inlet nip formed by the drying wire and its tension roll, with more dry air being supplied by means of these air jets into the pockets.

In a preferred embodiment of the present invention, there is a narrow passage between the wire and the pocket ventilation device at which, by the effect of the pumping effect of the wire, a positive pressure tends to be formed at an initial end of the passage which increases the amount of dry air that is received through the wire into the pocket.

In a preferred embodiment of the invention, at a trailing side of the wire relative to the blow box at which the wire runs from the guide roll onto the next drying cylinder, a nozzle blowing is arranged by means of which the pumping-out induced by the wire and taking place out of the pocket is reduced. In this manner, the amount of air passing into the pocket can be increased much more than the amount of air that is removed out of the pocket by the effect of the pumping-out of the wire. This means that the pocket becomes pressurized so that any excess quantity of air is discharged out through both ends of the pocket, which results in the substantial advantages that the edges of the web do not flutter and that the moisture profile of the pocket can also be straightened in the lateral areas of the web.

In view of the capacity of adjusting the transverse moisture profile of the web, the effects both of the blowing that disrupts the boundary layer and of the blowing applied directly into the nip extend principally over the width at which the blowing is directed in the transverse direction. When the blowing in the transverse direction is arranged to be adjustable by blocks, it is also possible to adjust the transverse moisture profile of the web by means of the blowings that can be directed in accordance with the present invention.

BREIF DESCRIPTION OF THE DRAWINGS

The present invention will be described in greater detail below with reference to certain exemplary embodiments thereof illustrated in the accompanying figures, and to which the present invention is not intended to be strictly confined. In the drawings, FIG. A is a schematic side view of a field of application of the present invention, i.e. in a drying cylinder group of the prior art that is provided with a twin-wire draw;

FIG. B is a schematic side view illustrating formation of a moist boundary layer in connection with a drying cylinder and a drying wire;

DESCRIPTION OF THE PREFERRED EMBODIMENTS

Figure 1A:
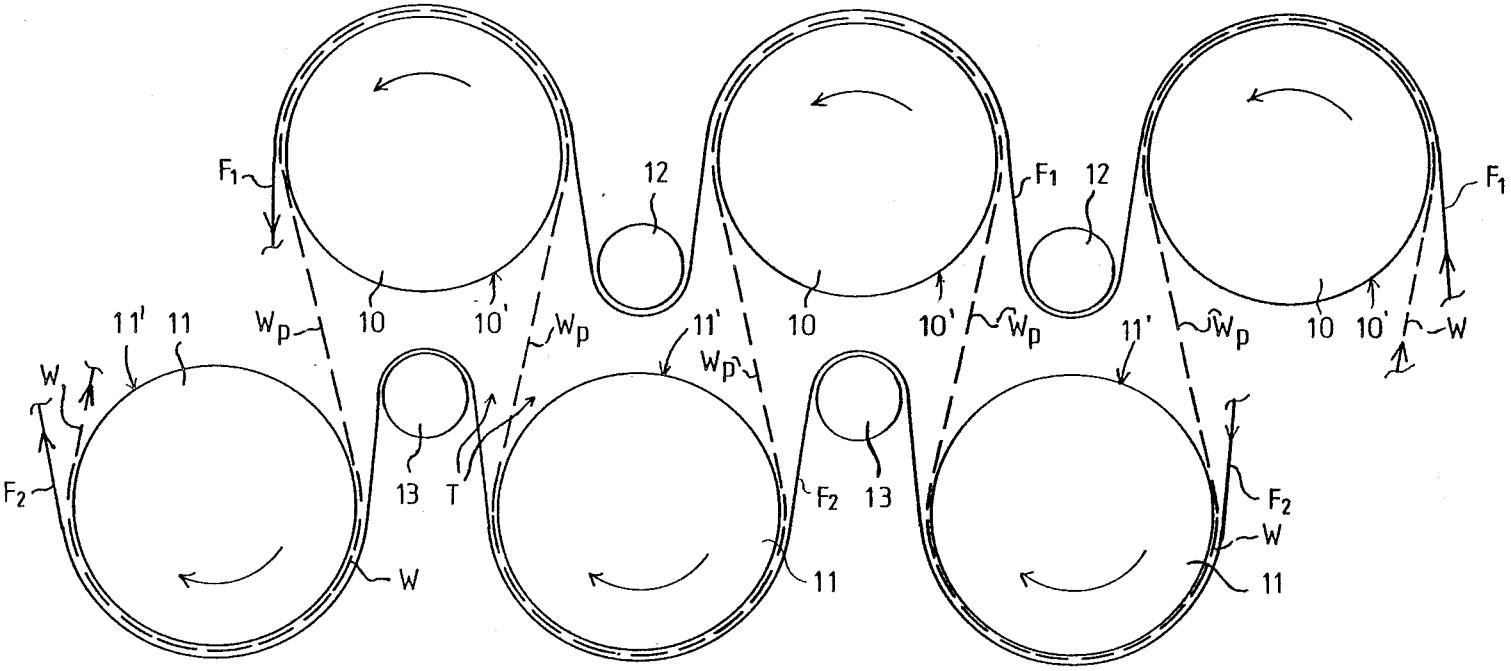
FIG.1A PRIOR ART
FIG. 1 is a schematic vertical sectional view illustrating the method and the device in accordance with the present invention.
Figure 1B:
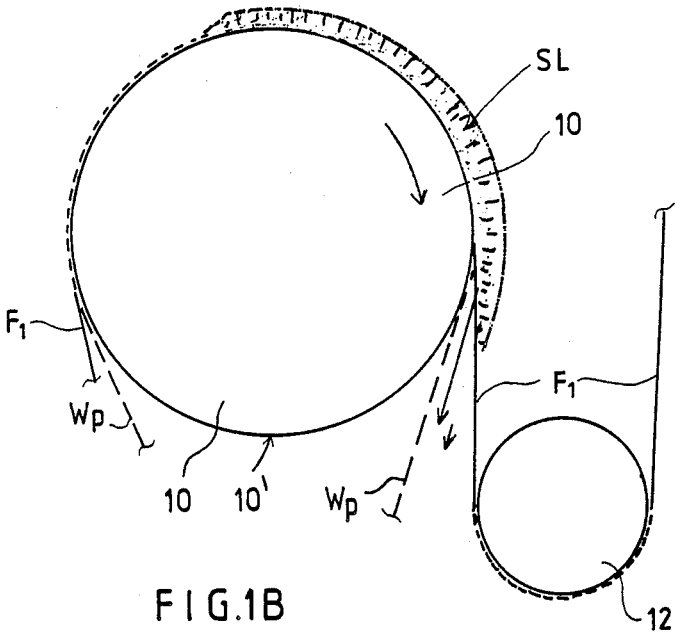

In the twin-wire draw of the web W to be dried as shown in FIG. A, which is known per se, the web W is situated on the lower drying cylinders 11 between the lower wire F2 and the heated cylinder face 11'. This is the reason why, in the twin-wire draw, the contact between the cylinders 10, 11 and the web W is good, as a result of which the evaporation out of the web W and the drying of the web W are relatively efficient. In the prior art twin-wire draw illustrated in FIG. A, the web W remains unsupported by the wires F1 and F2 on its long run Wp between the upper cylinder 10 and the lower cylinder 11, because the upper wire F1 runs via the upper wire guide rolls 12 and the lower wires F2 runs via the lower wire guide rolls 13. The long unsupported runs Wp of the web W cause difficulties when the speed of the machine becomes high, in particular because of fluttering of the runs Wp.

Figure 1:
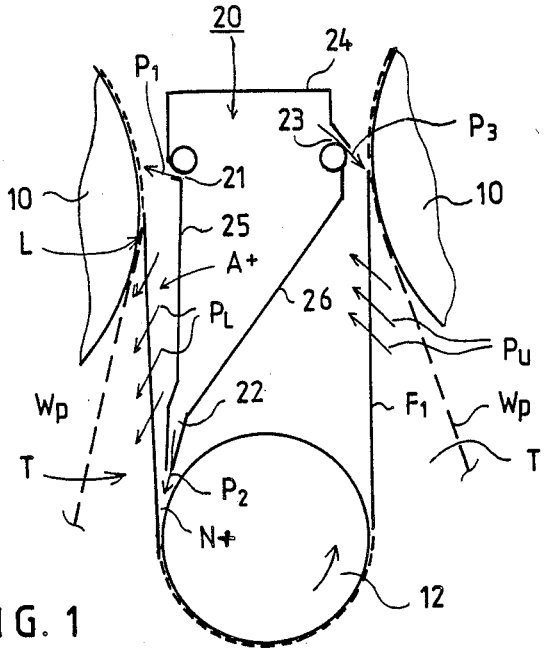

FIG. 1 is a schematic vertical sectional view of the method and the device of the present invention. As illustrated in FIG. 1, a blow box 20 in accordance with the present invention, and which is defined by a substantially horizontal wall 24 and by side walls 25 and 26, is provided in the spaces between the drying cylinders 10 above the guide rolls 12. In practical applications of the present invention, corresponding boxes 20 are also fitted in the spaces between the lower cylinders 11 illustrated in FIG. A and below the guide rolls 13. The boxes 20 are fitted in the area of the twin-wire draw, e.g. in one or several of the first groups with the twin-wire draw.

According to FIG. 1, a first blowing $p_1$ is directed at the drying wire F1 out of a first nozzle 21 of the box 20 within an area of a line at which the wire F1 departs from the cylinder 10. By means of the blowing $p_1$, a moist boundary layer SL (FIG. B) developed on the wire F1 is disrupted before or near the departing line L of the wire F1. The blowing $p_1$ from the nozzle 21 is directed so that the boundary layer SL is disrupted as efficiently as possible. By means of the blowing $p_1$, which is dry air, a sufficient amount of dry air being received into the space A+ between the box 20 wall 25 and the wire F1 is ensured at the same time. This dry air is, by the effect of the positive pressure generated in the area of the space A+, passed as flows $p_L$ through the wire F1 into the pocket T.

According to FIG. 1, the blow box 20 includes a second nozzle 22 out of which a blowing $p_2$ is directed into a pressurized inlet nip N+ between the guide roll 12 and the wire F1. By means of the blowing $p_2$, a flow of air through the wire F1 and partly a raised level of positive pressure in the space A+ are achieved which, for their part, increase the amount of dry air $p_L$ that enters into the pocket T through the inlet run of the wire F1.

According to FIG. 1, at a trailing side of the wire F1 between the guide roll 12 and the next drying cylinder 10 and in an area where the wire F1 meets the next drying cylinder 10, the blow box 20 is provided with a third nozzle 23 out of which a blow $p_3$ is directed against the outlet run of the wire F1. By means of this blowing $p_3$, the pumping out of air induced by the wire F1 and taking place out of the pocket T, is reduced. By the effect of the blowing $p_3$, the amount of air supplied into the pocket T can be increased substantially greater than the amount of air that escapes out of the pocket T in the direction of the arrows $p_u$. The excess amount of air supplied into the pocket T in the manner noted above is removed out of both ends of the pocket T. In other words, the pocket T becomes pressurized which provides the advantages that the running of the lateral areas of the web W is, in particular, stabilized and the fluttering thereof is reduced or completely eliminated. Moreover, the moisture profile of the drying air in the pocket T is also strainghtened at the proximity of the pocket edges.

Even though the operation of the blow box is described above in connection with the upper cylinder 10 and the upper wire F1 with respect to FIG. 1, it is emphasized that the corresponding method steps are also carried out in connection with the lower cylinders 11 and the lower wire F2 by means of a blow device similar to box 20.

Figure 2:
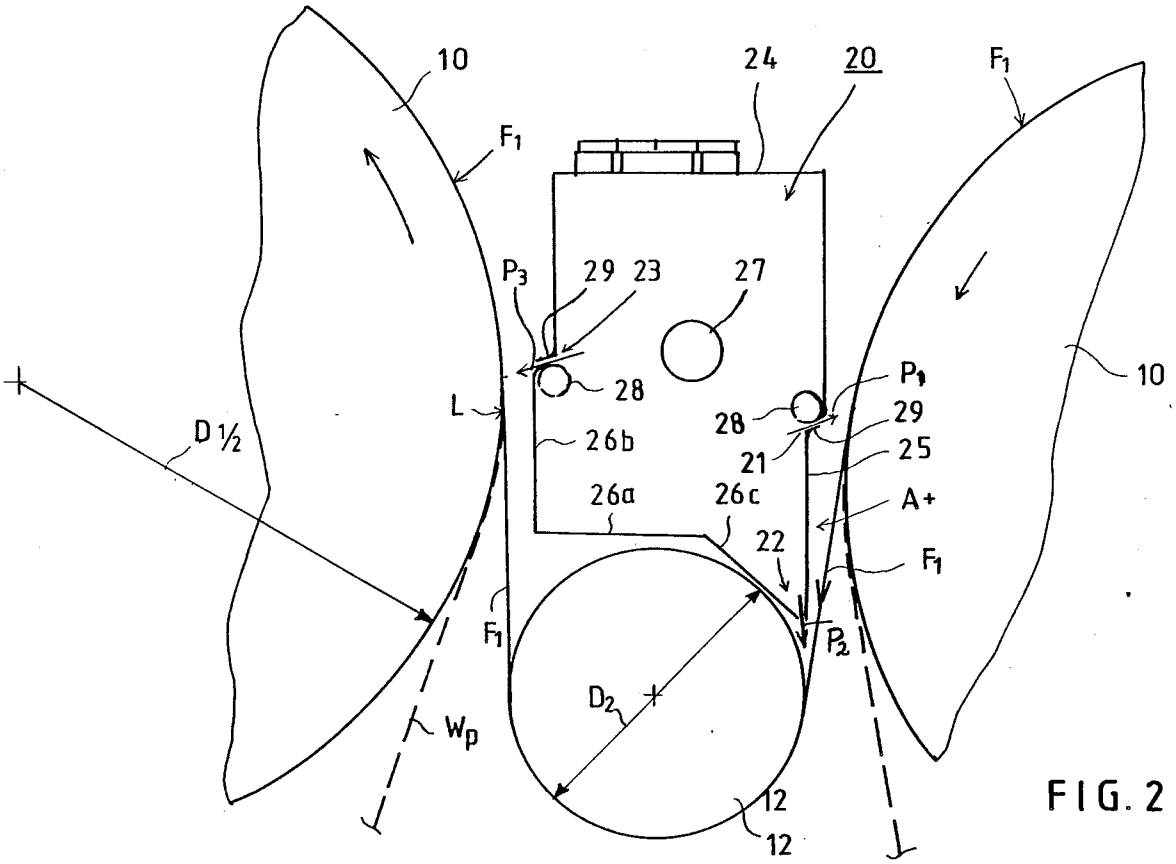
FIG. 2 is a vertical sectional view of a first exemplary embodiment of the present invention.

FIG. 2 illustrates a more detailed exemplary embodiment of the device in accordance with the present invention. Differing from FIG. 1, the blow box 20 includes wall parts **26*a* and 26*b* which are substantially perpendicular to one another, with the wall part 26*a* being placed as close as possible to a free sector of the guide roll 12. An extension of the wall part 26*a* forms a wall part 26*c* which ends in the second nozzle 22. The first nozzle 21 and third nozzle 23 are respectively formed between a respective tubular part 28 and a respective substantially planer wall 29 as illustrated. The nozzles 21 and 23 are preferably so-called coanda nozzles which are directed at the wire F1 optimally in view of disrupting the moist boundary layer SL. Dry air is supplied into the box 20 through an inlet pipe 27, this dry air being discharged from the interior of the box 20 through the nozzles 21, 22, 23** and producing the effects described above.

In FIG. 2, a diameter of the drying cylinder 10 is denoted by $D_1$ (i.e. the radius thereof is $D_{\frac{1}{2}}$), and the diameter of the guide roll by $D_2$. $D_1$ is, e.g.,=about 1830 mm, while $D_2$ is=about 600 mm. The measures $D_1$ and $D_2$ give an idea of the dimensional proportions of the device in accordance with the invention, said proportions being given in FIG. 2 as substantially corresponding to practical application.

Figure 3:
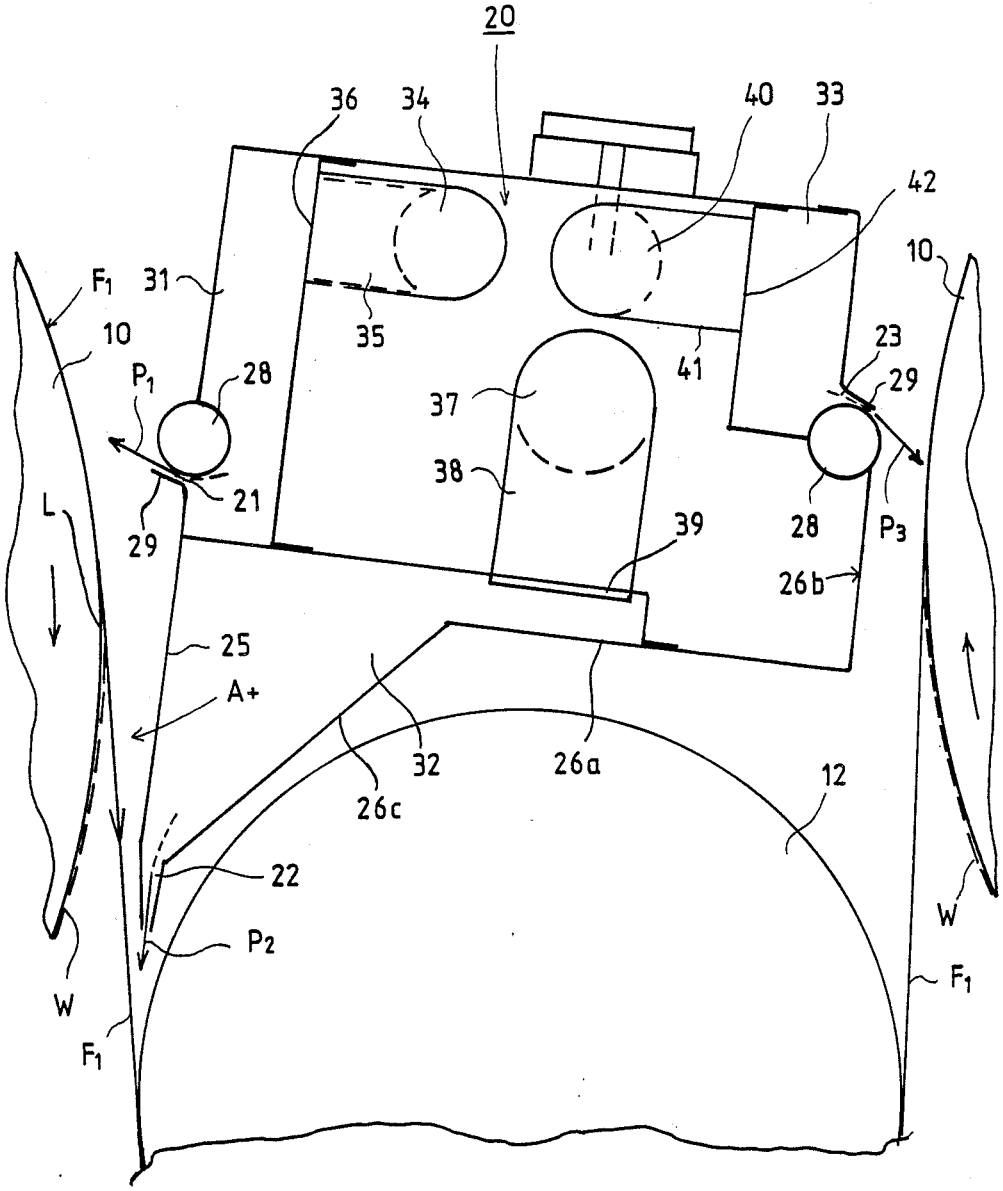
FIG. 3 is a vertical sectional view of a second exemplary embodiment of the present invention.

FIG. 3 shows a second, more detailed, exemplary embodiment of the present invention. According to FIG. 3, the blow box 20 has been divided into three compartments 31, 32, and 33. The first compartment 31 communicates with the first nozzle 21, the second compartment 32 communicates with the second nozzle 22, and the third compartment 33 communicates with the third nozzle 23. Blowing air is introduced into the first compartment 31 along an inlet pipe 34 and through pipes 35 and regulating means 36. Correspondingly, the blowing air is passed into the second compartment 32 through an inlet pipe 37 and its distributor pipe 38, and through regulating gates 39 thereof. The inlet air is passed into the third compartment 33 through an inlet pipe 40 and distributor pipes 41, and through the regulating gates 42 thereof.

If necessary, the compartments 31, 32, 33 are divided into blocks in the transverse direction, the air being passed into the blocks along different distributor pipes 35, 38, 41. The number of blocks is, e.g., about 5 to 10 pcs., placed side by side. The blocks placed side by side in the compartments 31, 32 and 33 are separated from one another by means of substantially vertical partition walls (not illustrated), and the air quantities thereof can be regulated by means of regulating dampers or gates 36, 39, 42. With respect to the construction of the blow box and in particular with respect to the details of the regulation by or in blocks, reference is made in this connection to the Valmet Published Finnish Patent Application No. 73,259, FIG. 5, and to the related description of the invention.

It is possible to introduce different air such as dry replacement air, hot circulation air, and/or a suitable mixture of the same into the different compartments 31, 32, 33 of the blow box 20 shown in FIG. 3, so that the modes of effecting of the different blowings $p_1$, $p_2$, $p_3$, as well as the profile adjusting capacity of the device, are taken in to account.

The preferred embodiment of the present invention comprises all three nozzles 21, 22 and 23. A width s of the nozzle slots in the nozzles 21 and 23 is, as a rule, within the range of s=about 2 . . . 5 mm., preferably s=about 3 mm, whereas the width s of the nozzle slot of the nozzle 22 is, as a rule, within the range of s=about 4 . . . 10 mm., preferably s=about 6 mm. The speeds v of the blowings $p_1$, $p_2$, and $p_3$ are, as a rule, within the range of v=about 15 . . . 30 m/s, preferably v=about 20 m/s.

The invention may also be carried out so that the third blowing $p_3$ and the corresponding nozzle 23 are omitted. This embodiment is used, in particular, when fluttering of the web W does not cause major problems.

In some exceptional cases, the invention may also be accomplished so that both the third blowing $p_3$ and the second blowing $p_2$ and the corresponding nozzles 22 and 23 are omitted, in which case the moist boundary layers present in connection with the cylinders 10, 11 and the wires F1 and F2 are disrupted in accordance with the present invention by means of just the blowing $p_1$ of the nozzle 21 alone. In such a case, the air quantity in the blowing $p_1$ must be so large that it ensures an adequate quantity of inlet air supplied through the runs of the wires F1 and F2 at the inlet side through the pressurized passage area A+.

The preceding description of the present invention is merely exemplary, and is not intended to limit the scope thereof in any way.

What is claimed is:

1. Method in a cylinder dryer of a paper machine in which a paper web is guided by an upper wire around upper cylinders and by a lower wire around lower cylinders, with these wires being guided over faces of the respective cylinders and by guide rolls situated in spaces between respective upper cylinders or respective lower cylinders, so that the web is pressed by the upper wire into direct drying contact with the faces of the upper cylinders along an upper line of cylinders and correspondingly pressed by the lower wire onto the faces of the lower cylinders along a lower line of cylinders, and the web is additionally passed from one line of cylinders to the other over a certain distance as an open draw, comprising the steps of directing a blowing of drying air at at least one of the drying wires within an area of a line and which the respective drying wire is detached from a respective cylinder, thereby disrupting a moist boundary layer which is derived from water diffused from the web and onto the respective wire, supplying a sufficient amount of dry air on an inlet run of the upper or lower wire from the respective drying cylinder to a respective guide roll, directing the air to pass from an area of a pressurized space formed on the inlet run through the respective wire and into a pocket space defined by the respective wire and a respective free draw of the web, applying a second blowing into a pressurized inlet nip formed between the respective wire and guide roll, thereby producing an intensified flow of air through the wire so as to supply additional drying air into the pocket space, and regulating said first and second blowings over a transverse direction of the web, so as to control at least one of moisture profile of the web to be dried and transverse flows taking place in the pocket space.

2. The method of claim 1, wherein said blowings are regulated by blocks.

3. Method in a cylinder dryer of a paper machine in which a paper web is guided by an upper wire around upper cylinders and by a lower wire around lower cylinders, with these wires being guided over faces of the respective cylinders and by guide rolls situated in spaces between respective upper cylinders or respective lower cylinders, so that the web is pressed by the upper wire into direct drying contact with the faces of the upper cylinders along an upper line of cylinders and correspondingly pressed by the lower wire onto the faces of the lower cylinders along a lower line of cylinders, and the web is additionally passed from one line of cylinders to the other over a certain distance as an open draw, comprising the steps of directing a blowing of drying air at at least one of the drying wires within an area of a line and which the respective drying wire is detached from a respective cylinder, thereby disrupting a moist boundry layer which is derived from water diffused from the web and onto the respective wire, applying a second blowing into a pressurized inlet nip formed between the respective wire and guide roll, thereby producing an intensified flow of air through the wire, so as to supply additional drying air into the pocket space, applying a third blowing to an area at a trailing side of the respective wire placed between the respective guide roll and subsequent drying cylinder and where the respective wire meets the subsequent drying cylinder, and regulating said first, second, and third blowings over a transverse direction of the web, so as to control at least one of moisture profile of the web to be dried and transverse flows taking place in the pocket space.

4. The method of claim 3, wherein said blowings are regulated by blocks.

5. Device in a cylinder dryer of a paper machine in which a twin-fabric draw is used, said devive being located in at least one of spaces between adjoining dryer cylinders and defined by a respective one of the drying wires running over the adjoining cylinders and by free sectors of guide rolls for guiding the respective drying wire, said device comprising a blow box extending over substantially the entire transverse width of the respective drying wire and comprising, as a nozzle slot or corresponding series of nozzle holes, a first blow nozzle situated transversely substantially over the entire width of the respective drying wire and within an area in which the respective drying wire is detached from a web and from a respective cylinder while running further to a respective guide roll, said first blow nozzle being directed or oriented in such a way that it is possible to provide through said nozzle a blowing that efficiently disrupts a boundary layer of moist air that has developed on the respective wire, a second nozzle directed or positioned so as to blow air out of said blow box and into a pressurized inlet nip between the respective drying wire and guide roll, a wall part situated parallel to the run of the wire facing the same and situated at a certain distance from the wire, with said wall part and the wire run facing the same defining a substantially oblong passage in which positive pressure develops principally by effect of said blowings, and by the effect of said positive pressure air flows through the run of the wire between the respective cylinder and guide roll and into an inside pocket space between the wire run and detached web, wherein said blow box additionally comprises a third nozzle provided in a wall opposite to said first nozzle and fitted in such a manner to apply a blowing of air in an area in which the respective drying wire meets a subsequent drying cylinder when arriving from ther respective guide roll, and wherein said blow box is divided into different compartments out of which air is passed into said respective nozzles, said compartments communicating with different air supply pipes via connector pipes or series of distributor pipes.

6. The combination of claim 5, wherein said compartments are each divided by substantially vertical partition walls into different blocks which communicate with regulating means, by means of which quantity of air to be passed into said different blocks can be regulated so as to control at least one of transverse moisture profile of the web and transverse flows prevailing in the pocket space.

7. Device in a cylinder dryer of a paper machine in which a twin-fabric draw is used, said devive being located in at least one of spaces between adjoining dryer cylinders and defined by a respective one of the drying wires running over the adjoining cylinders and by free sectors of guide rolls for guiding the respective drying wire, said device comprising a blow box extending over substantially the entire transverse width of the respective drying wire and comprising, as a nozzle slot or corresponding series of nozzle holes, a first blow nozzle situated transversely substantially over the entire width of the respective drying wire and within an area in which the respective drying wire is detached from a web and from a respective cylinder while running further to a respective guide roll, said first blow nozzle being directed or oriented in such a way that it is possible to provide through said nozzle a blowing that efficiently disrupts a boundary layer of moist air that has developed on the respective wire, a second nozzle directed or positioned so as to blow air out of said blow box and into a pressurized inlet nip between the respective drying wire and guide roll, a wall part situated substantially parallel between the run of the wire facing the same and situated at a certain distance from the wire, with said wall part and the wire run facing the same defining a substantially oblong passage in which positive pressure develops principally by effect of said blowings, and by the effect of said positive pressure air flows through the run of the wire between the respective cylinder and guide roll and into an inside pocket space between the wire run and detached web, wherein said blow box is divided into different compartments out of which air is passed into said respective nozzles, said compartments communicating with different air supply pipes via connector pipes or series of distributor pipes.

8. The combination of claim 6, wherein said compartments are each divided by substantially vertical partition walls into different blocks which communicate with regulating means, by means of which quantity of air to be passed into said different blocks can be regulated so as to control at least one of transverse moisture profile of the web and transverse flows prevailing in the pocket space.

* * * * *